US005711531A

United States Patent [19]

Avory et al.

[11] Patent Number: 5,711,531

[45] Date of Patent: Jan. 27, 1998

1

[54] ELECTRICAL INITIATOR SEAL

[75] Inventors: Mark Lucas Avory, Foster City; William David Fahey, Cupertino; Stewart Shannon Fields, Redwood City, all of Calif.

[73] Assignee: Quantic Industries, Inc., San Carlos, Calif.

[21] Appl. No.: 478,641

[22] Filed: Jun. 7, 1995

Related U.S. Application Data

[62] Division of Ser. No. 140,650, Oct. 20, 1993.

[51] Int. Cl.[6] ..... F42B 5/30

[52] U.S. Cl. ..... 277/12; 102/467

[58] Field of Search ..... 277/12, 53, 166, 277/189, 208; 102/465, 466, 467, 430

[56] References Cited

U.S. PATENT DOCUMENTS

| | | |
|---|---|---|
| 2,408,125 | 9/1946 | Rolfes . |
| 2,515,780 | 7/1950 | Lefren . |
| 2,532,770 | 12/1950 | Huyett . |
| 2,695,563 | 11/1954 | Mulqueeny . |
| 2,767,655 | 10/1956 | Seavey . |
| 2,872,870 | 2/1959 | Gey . |
| 2,882,819 | 4/1959 | Schulz . |
| 2,918,001 | 12/1959 | Alford . |
| 2,955,535 | 10/1960 | Show et al. . |
| 3,059,576 | 10/1962 | Haefner . |
| 3,059,579 | 10/1962 | Bessiere . |
| 3,101,669 | 8/1963 | Gatley et al. . |
| 3,198,117 | 8/1965 | Purdy et al. . |
| 3,306,202 | 2/1967 | Menicbelli et al. . |
| 3,320,104 | 5/1967 | Stadler et al. . |
| 3,351,012 | 11/1967 | Wilson . |

(List continued on next page.)

FOREIGN PATENT DOCUMENTS

| | | |
|---|---|---|
| 0 314 898 A1 | 5/1989 | European Pat. Off. . |
| 0 402 622 | 12/1990 | European Pat. Off. . |
| 0 482 755 | 4/1992 | European Pat. Off. . |

(List continued on next page.)

OTHER PUBLICATIONS

*Engineering Design Handbook Explosives Series Properties of Explosives of Military Interest,* AMCP 706–177, United States Army Command, Washington, D.C. 1971, p.193.

*Handbook of Chemistry and Physics,*68th Edition, CRC Press, Boca Raton, Florida, 1987, p. B–68.

Fluorel FC—Technical Information, 3M Technical Department, Minnesota, (612) 733–5353.

Non–Disclosure and Proprietary Information Agreement dated Apr. 1, 1992 with associated written communications.

Kraton Thermoplastic Rubber Typical Properties, Shell Chemical Co. 1992.

*Primary Examiner*—Scott Cummings

*Attorney, Agent, or Firm*—Wilson Sonsini Goodrich & Rosati

[57] ABSTRACT

The invention relates to an electrical initiator which can be used with an automobile air bag or seat belt pretensioner. The initiator comprises a header, a cup, conducting pins, epoxy pin seals, a bridgewire, a primer, and an output charge. The header and the cup are composed of an insulating dielectric material capable of being ultrasonically welded together. The header secures the pins. Each pin is electrically conductive and each is formed with a buttress knurl to form a seal when each pin is inserted into the header. Additionally, the pins are further sealed to the header by an epoxy sealant. The bridgewire connects the pins together on one side of the header. An electrical signal through the bridgewire generates heat igniting the primer. Primer reacts with the output charge that in turn ignites a solid gas generant that produces gas that fills air bags or activates the gas generator that drives seat belt pretensioners. The primer contacts the bridgewire. The output charge contacts the primer. The output charge is in the cup, and the cup is ultrasonically welded to the header to provide, along with the pin seals, an environmentally secure seal.

6 Claims, 6 Drawing Sheets

U.S. PATENT DOCUMENTS

| | | | |
|---|---|---|---|
| 3,357,190 | 12/1967 | Cassidy et al. . | |
| 3,414,292 | 12/1968 | Oldberg et al. . | |
| 3,449,999 | 6/1969 | Corren et al. . | |
| 3,541,961 | 11/1970 | Larson . | |
| 3,557,699 | 1/1971 | Hubbard . | |
| 3,572,247 | 3/1971 | Warshall . | |
| 3,601,655 | 8/1971 | Andersen . | |
| 3,640,224 | 2/1972 | Petrick et al. . | |
| 3,686,934 | 8/1972 | Farrand et al. . | |
| 3,695,179 | 10/1972 | Rainone et al. . | |
| 3,867,885 | 2/1975 | Gawlick et al. . | |
| 3,906,858 | 9/1975 | Craig et al. . | |
| 3,960,514 | 6/1976 | Teng et al. . | |
| 3,971,320 | 7/1976 | Lee . | |
| 4,040,356 | 8/1977 | Voreck, Jr. et al. . | |
| 4,110,813 | 8/1978 | Hoheisel et al. . | |
| 4,128,058 | 12/1978 | Mixon, Jr. et al. . | |
| 4,152,988 | 5/1979 | Haas et al. . | |
| 4,170,939 | 10/1979 | Hobeisel et al. . | |
| 4,203,787 | 5/1980 | Kirchoff et al. . | |
| 4,220,088 | 9/1980 | Kimura et al. . | |
| 4,261,263 | 4/1981 | Coultas et al. . | |
| 4,271,453 | 6/1981 | Yajima et al. . | |
| 4,296,084 | 10/1981 | Adams et al. . | |
| 4,299,167 | 11/1981 | Bryan . | |
| 4,306,499 | 12/1981 | Holmes . | |
| 4,307,663 | 12/1981 | Stonestrom . | |
| 4,316,412 | 2/1982 | Dinegar et al. . | |
| 4,363,272 | 12/1982 | Simmons . | |
| 4,369,079 | 1/1983 | Shaw . | |
| 4,369,707 | 1/1983 | Budde . | |
| 4,370,930 | 2/1983 | Strasser et al. . | |
| 4,422,381 | 12/1983 | Barrett . | |
| 4,457,517 | 7/1984 | Dunegan | 277/70 |
| 4,561,675 | 12/1985 | Adams et al. . | |
| 4,592,280 | 6/1986 | Shores . | |
| 4,612,578 | 9/1986 | Breithaupt . | |
| 4,616,565 | 10/1986 | Reinovsky . | |
| 4,621,578 | 11/1986 | Vallieres et al. . | |
| 4,648,319 | 3/1987 | Westerlund et al. . | |
| 4,696,231 | 9/1987 | Bryan . | |
| 4,708,060 | 11/1987 | Bickes, Jr. et al. . | |
| 4,722,551 | 2/1988 | Adams . | |
| 4,726,296 | 2/1988 | Leshner et al. | 102/467 |
| 4,729,315 | 3/1988 | Proffit et al. . | |
| 4,734,265 | 3/1988 | Nilsson et al. . | |
| 4,893,109 | 1/1990 | Vrabel et al. . | |
| 4,939,993 | 7/1990 | Curutchet et al. . | |
| 4,943,086 | 7/1990 | Cunningham . | |
| 4,952,629 | 8/1990 | Liang . | |
| 4,959,011 | 9/1990 | Nilsson . | |
| 4,976,200 | 12/1990 | Benson et al. . | |
| 4,978,482 | 12/1990 | Johnson et al. . | |
| 5,005,486 | 4/1991 | Lenzen . | |
| 5,015,311 | 5/1991 | Ramaswamy . | |
| 5,036,768 | 8/1991 | Dow et al. . | |
| 5,044,278 | 9/1991 | Campbell . | |
| 5,046,429 | 9/1991 | Swann et al. . | |
| 5,054,395 | 10/1991 | Vetter et al. . | |
| 5,060,974 | 10/1991 | Hamilton et al. . | |
| 5,076,607 | 12/1991 | Woods et al. . | |
| 5,080,393 | 1/1992 | Dixon, Jr. et al. . | |
| 5,085,146 | 2/1992 | Baginski . | |
| 5,099,762 | 3/1992 | Drapala . | |
| 5,100,170 | 3/1992 | Mihm et al. . | |
| 5,109,772 | 5/1992 | Cunningham et al. . | |
| 5,131,679 | 7/1992 | Novak et al. . | |
| 5,136,952 | 8/1992 | Bennett, Jr. . | |
| 5,140,906 | 8/1992 | Little, II . | |
| 5,167,426 | 12/1992 | Mihm et al. . | |
| 5,178,547 | 1/1993 | Bonas et al. . | |
| 5,206,455 | 4/1993 | Williams et al. . | |
| 5,259,644 | 11/1993 | Albrecht et al. . | |
| 5,280,927 | 1/1994 | Greisinger | 277/220 |
| 5,375,523 | 12/1994 | Morris . | |
| 5,387,645 | 2/1995 | Montag et al. . | |
| 5,454,320 | 10/1995 | Hilden et al. . | |

FOREIGN PATENT DOCUMENTS

| | | |
|---|---|---|
| 0 482 755 A1 | 4/1992 | European Pat. Off. . |
| 0 502 630 A2 | 9/1992 | European Pat. Off. . |
| 0 505 823 | 9/1992 | European Pat. Off. . |
| 0 512 682 A2 | 11/1992 | European Pat. Off. . |
| 0 512 747 A1 | 11/1992 | European Pat. Off. . |
| 2.116.782 | 6/1972 | France . |
| 2599 361 | 12/1987 | France . |
| 2599361 A1 | 12/1987 | France . |
| 2120 043 | 11/1971 | Germany . |
| 2131 479 | 1/1972 | Germany . |
| 2133 050 | 1/1972 | Germany . |
| 2443 267 | 3/1975 | Germany . |
| 2755 649 | 6/1978 | Germany . |
| 3837332 A1 | 6/1990 | Germany . |
| 39 39 258 A1 | 6/1991 | Germany . |
| 4026697 | 3/1992 | Germany . |
| 4224477 | 2/1993 | Germany . |
| 53-96135 | 8/1978 | Japan . |
| 4-24144 | of 1990 | Japan . |
| 1 361 904 | 7/1974 | United Kingdom . |
| 2 238 672 | 6/1991 | United Kingdom . |
| 2 245 775 | 1/1992 | United Kingdom . |
| WO 90/01670 | 2/1990 | WIPO . |

ELECTRICAL INITIATOR SEAL

This application is a divisional of copending application Ser. No. 08/140,650, filed Oct. 20, 1993.

BACKGROUND OF THE INVENTION

The present invention relates to the field of electrical initiators and gas generators. More particularly, the present invention relates to electrical initiators used to ignite gas generators for inflating air bags and for operating seat-belt pretensioners in automobiles during collisions. It also relates to gas generators.

Air bags and seat belt pretensioners play an important role in reducing death or injuries in collisions. An initiator has a crucial role in activating these safety mechanisms by quickly converting an electrical signal from a collision detection system to rapidly moving, hot particles. These hot particles ignite a solid gas generant which in turn produces the gas necessary to inflate an air bag or activate a seat-belt pretensioner.

Conceptually, an electrical initiator contains a number of components. It has a header and a cup that are attached together to form a cavity. An initiator also has two electrically conductive pins that provide a conduction path from the outside of the header and cup into the cavity. Inside the cavity, the pins are connected together by an electrically resistive device, called a resistor in this discussion.

When the resistor is composed of a piece of metal, the resistor is called a bridgewire.

The resistor is surrounded by a chemical compound called the primer that is very sensitive to temperature. Adjacent to the primer is another chemical compound called the output charge. The output charge and the primer together are referred to as the ordnance. The ordnance is contained by the formed cavity.

The initiator is contained in a device called a gas generator. For simplicity in describing the operation of an initiator in the context of a safety system, the cup of the initiator can be thought of as being surrounded by a solid chemical called the gas generant. When the solid gas generant is ignited, it produces a gas.

The operation of an initiator begins with the arrival of an electrical signal at the conductive pins. The resistor converts the electrical energy in the signal into thermal energy. That thermal energy causes the resistor temperature to rise which starts a pyrotechnic reaction in the primer. The pyrotechnic reaction in the primer causes a pyrotechnic reaction in the output charge. The increased pressure and heat generated by these reactions causes the cup to rupture. The high pressure spreads hot gases and particles outward to ignite the solid gas generant to produce gas. This gas can then be used to inflate an air bag or move a piston to operate a seat belt pretensioner.

A commercially successful initiator used in automotive safety systems must be fast, reliable and consistent. It also must be economical to construct.

An initiator must be reliable and fast because it must reliably ignite when required and never ignite unintentionally. An initiator can spend years unused in a car before it needs to work. It must be fast because the gas generators must inflate an air bag or tighten a seat belt in time to prevent injury to the automobile occupants. It must be fast so that the safety system designers can make sure that all parts of the safety system work at the precisely the proper time to provide the protection to the occupants.

Some initiators requiring high reliability and consistency use a metal header and employ a glass-to-metal seal or a ceramic-to-metal seal between the pins and the header, and weld a metal cup to the header. In these initiators one or both pins are fed through the metal header via a glass or ceramic insulator which seals the metal pin to the insulator and the insulator to the metal header. If only one pin is insulated from the header, the header itself acts as part of the conductive path to the cavity.

The glass-to-metal seal or ceramic-to-metal seal is a hermetic seal and is strong enough to hold the pin or pins in place during the time that the initiator is operating. These types of seals isolate the resistor, the primer and the output charge from external moisture and humidity fluctuations. Moisture in the ordnance reduces the initiator's ability to fire promptly and consistently upon receipt of the proper electrical signal.

An initiator must be economical to build. Glass-to-metal, ceramic-to-metal and metal-to-metal welded seals are expensive. They may be the most expensive aspect of constructing an initiator. Unfortunately, initiators using less expensive materials such as nylon are much less reliable. For instance, an initiator may use a plastic header and cup. Sometimes initiator manufacturers attempt to provide an environmental seal between the header and cup by use of crimps or potting material. Although this type of initiator is less expensive, it does not provide a seal suited for the demands of the automotive environment, nor is it able to provide the long term reliability critical for this type of safety application.

Existing initiators using plastic are not effective in isolating the primer and output charge from the environment. A path for the intrusion of moisture may exist between the pins and the plastic header. For example, some initiators are constructed by molding the pins in the header. The header may pull away from the pins when the injected plastic cools, thus leaving a path for moisture.

Plastic headers and cups have very large coefficients of thermal expansion compared to glass-to-metal headers. Expansion and contraction over a long lifetime, e.g. 15 years, in an automotive environment can mechanically stress the resistor. Fractures in the resistor can cause electrical problems that lead to late firing of the initiator or even complete failure.

Some initiators have the resistor attached to the pins with solder one problem with this approach is that the solder flux can contaminate the primer. Soldering also does not guarantee a reliable connection. Both of these problems can make the initiator unreliable. In addition, soldering requires additional materials, i.e. solder and flux. This makes an initiator using these materials more difficult and expensive to build than one without those materials.

When properly deployed, the initiator will receive an electrical signal from the sensing system. However, the initiator can be inadvertently triggered by static electricity generated while the initiator is being built or installed. This creates a substantial safety hazard to workers and equipment.

The ideal output charge would have several important characteristics. It would maintain its ignition and combustion characteristics in the presence of moisture. It would produce numerous hot particles to ignite the gas generant. It would also be relatively insensitive to ESD. Although far from ideal, many initiators use black powder as an output charge.

Initiators have used a primer composed of normal lead styphnate with nitrocellulose as a binder. However, this primer does not have good heat transfer properties and will fail the no-fire requirement unless a large diameter bridgewire is used or the primer's heat transfer characteristics are modified. A typical no-fire requirement is that the primer must not ignite 99.9% of the time with a 95% confidence level at 200 milliamps applied for 10 seconds at 85° C. However, a larger bridgewire will cause the initiator to have a slower response time, which may lead to failing the response time requirement and the all-fire requirement. A typical all-fire requirement is that the primer must ignite 99.9% of the time with a 95% confidence level at 800 milliamps applied for 2 milliseconds at −35° C.

Because nitrocellulose is less thermally stable than normal lead styphnate and because it does not provide the primer with good heat transfer characteristics, primers using nitrocellulose have poor long term aging characteristics, poor thermal heat sink capability, and lack the required resiliency to survive thermal and mechanical shock. The lack of resiliency means that the primer is stiff and brittle, and therefore is incompatible with an ultrasonic welding process.

SUMMARY OF INVENTION

The present invention provides a low cost electric initiator with high reliability. It achieves the reliability of an initiator having more expensive components by its selection of the pins' structure, the attachment of the pins to the header, the attachment of the header to the cup, attachment of the resistor to the pins, resistor structure, and output charge and primer.

In one embodiment, the present invention uses pins formed with buttress knurls (i.e. barbs). One purpose of the buttress knurls is to hold the pins in place once they are inserted. Another purpose is to form an environmental seal by biting into the plastic at many locations creating a labyrinth seal. When pins having buttress knurls are inserted into a plastic header with the appropriate amount of force, the elastic properties of the plastic cause the header to snap back to seal the pins in place.

To provide an additional seal for the pins, a resilient epoxy is placed in small wells at the bottom of the header where the pins exit the header. The epoxy bonds to the pins and to the header forming another environmental seal on the pins. Preventing leaks via the pins is one of the contributions of the present invention.

The header and cup of the present invention are each made by injection molding of polybutylene terephthalate (PBT). One suitable plastic is Valox DR48. A Valox DR48 header and cup can withstand the rigors of the automotive environment and are capable of being ultrasonically welded together.

One embodiment of the present invention uses a metal bridgewire for a resistor and metal resistance welds to provide high reliability in attaching the bridgewire to the pins. It also minimizes the risk of contaminating or interacting with the primer or output charge because there is no solder or flux.

The present invention provides a small loop in the bridgewire as a stress relief to provide for the situation where the metal pins move because of thermal expansion and contraction of the plastic header.

In a preferred embodiment, the present invention uses $BKNO_3$ as an output charge for at least three reasons. First, $BKNO_3$ ignition and combustion characteristics are much less sensitive to moisture than conventional black powder. This helps make the present invention more reliable and predictable in the field and easier to manufacture. Second, $BKNO_3$ produces more hot particles and more metallic slag than black powder. This helps the present invention ignite the gas generant more efficiently than conventional initiators. Third, $BKNO_3$ is less susceptible to ESD than black powder. This makes constructing and using the present invention safer than constructing and using conventional initiators.

The present invention provides for doping the primer with microscopic particles of aluminum powder to increase the heat transfer characteristics of the normal lead styphnate based primer.

The present invention attaches the cup to the header using an ultrasonic weld. This weld provides a high quality environmental seal between the header and the cup. In an alternate embodiment, the cup can be attached to the header with a thermal weld.

The present invention uses a thermally stable and resilient binder to provide a primer that is more resistant to long term, high temperature aging and thermal shock. This binder is resilient, and thus protects whatever device, such as a metal bridgewire, is used for the resistor from mechanical shock during the ultrasonic welding process.

In addition, the present invention's use of a plastic with high dielectric strength provides good ESD protection. The ultrasonic weld prevents an air path for discharge. The use of a sufficient thickness of the plastic with high dielectric strength insulates the primer and output charge from ESD avoiding the need for a separate spark gap.

DETAILED DESCRIPTION OF THE PREFERRED EMBODIMENT

The following description is the best contemplated mode of carrying out the invention. This description is made for the purpose of illustrating the general principles of the invention and should not be taken in a limiting sense. The scope of the invention is best determined by reference to the appended claims. In the accompanying drawings like numerals designate like parts in the several figures.

Figure 1:
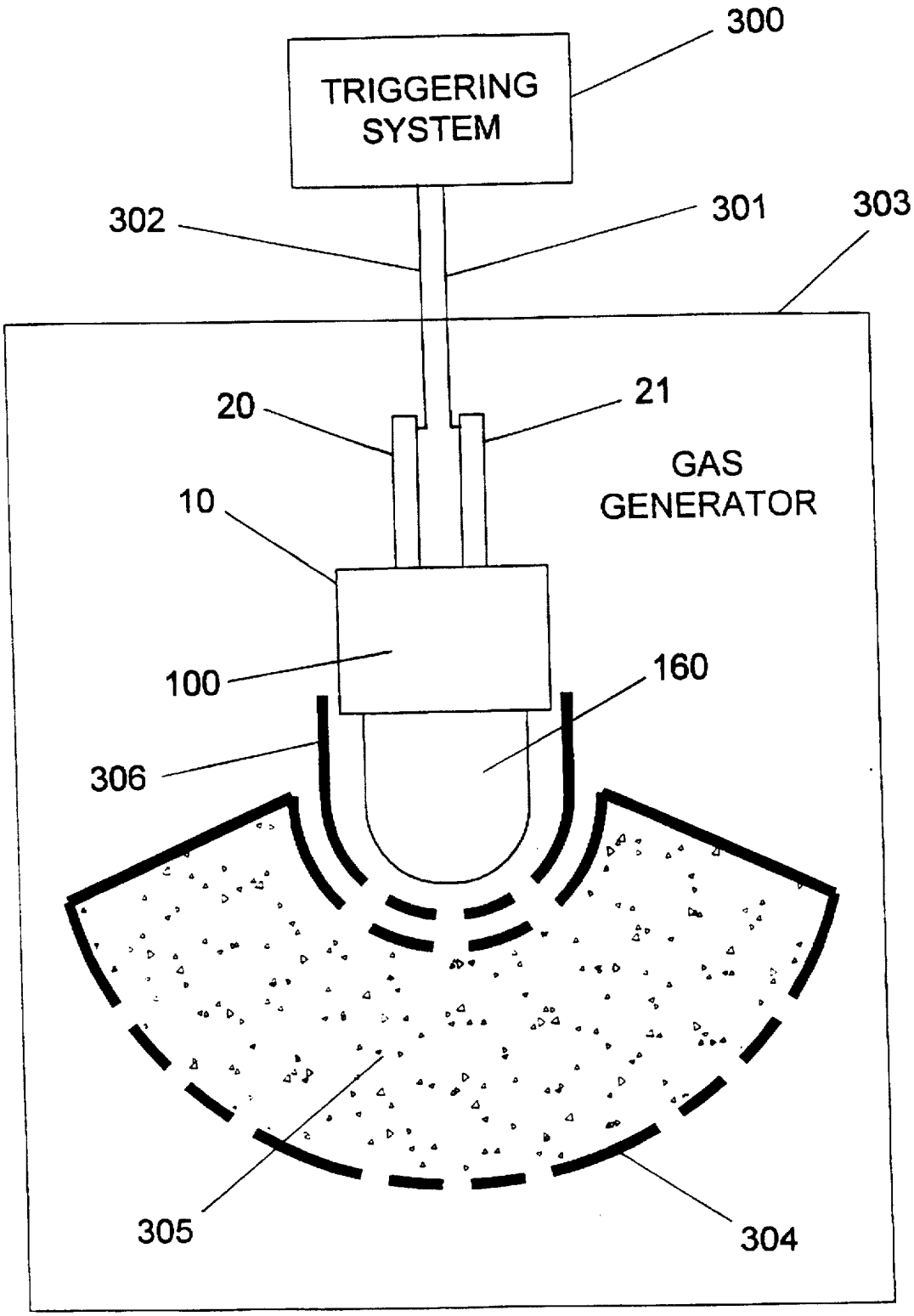
FIG. 1 is a block diagram of an embodiment of a gas generation system using an embodiment of an electrical initiator.

FIG. 1 is a block diagram showing how an initiator 10 of the present invention may be used as part of a gas generation system. The initiator 10 is connected to a triggering system 300 by electrical connections 301 and 302. The initiator 10 is within a gas generator 303. The gas generator 303 contains a gas generant enclosure 304 that holds a solid gas generant 305. The gas generant enclosure 304 has small holes on the surface located away from initiator 10 to allow gas created from burning solid gas generant 305 to exit the system. The gas generant enclosure 304 also has holes or burst regions on the surface closest to initiator 10. A director can 306 is a metallic container with holes that directs the gas and particles from a fired initiator 10 into the gas generant enclosure 304.

Figure 2:
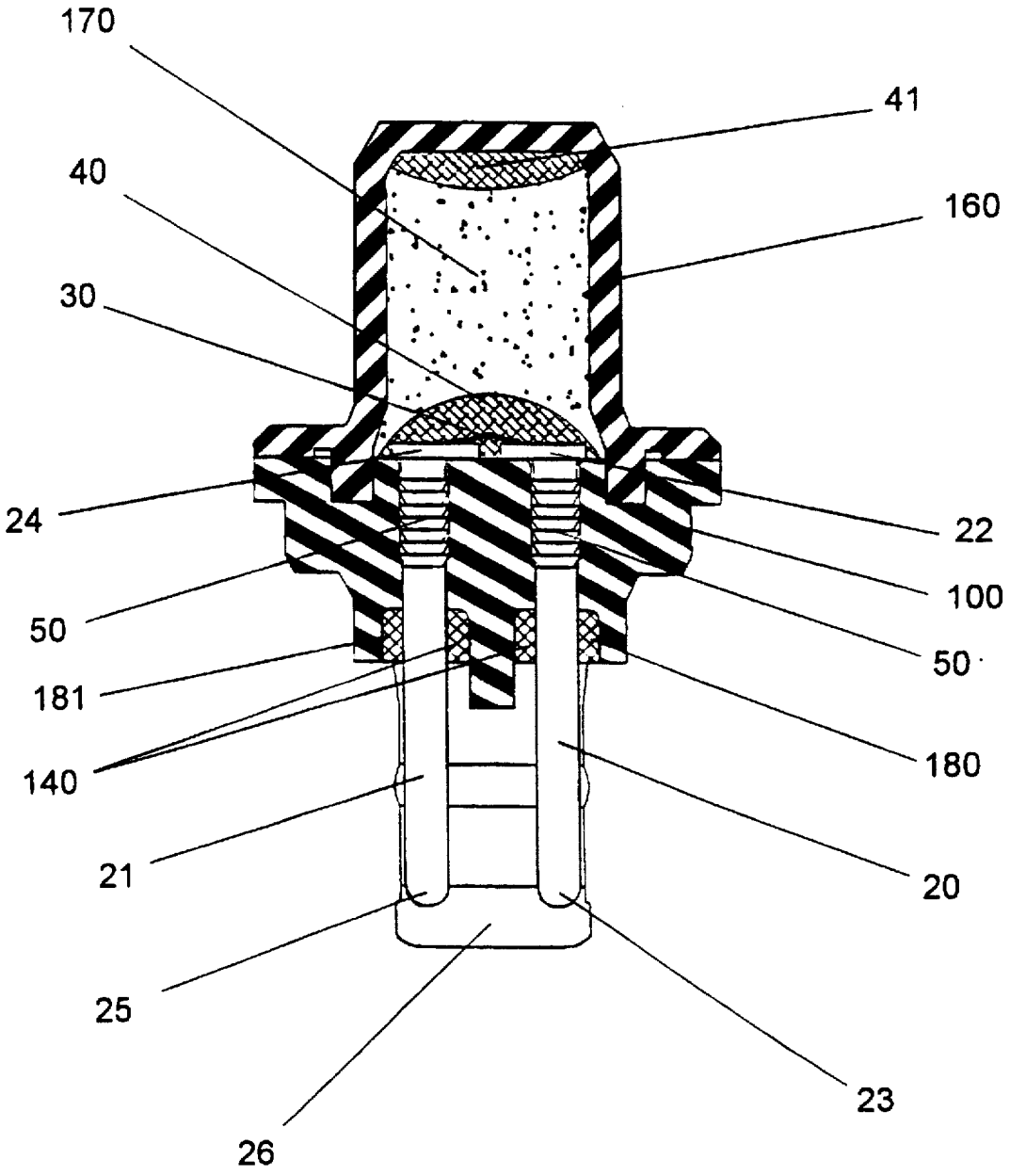
FIG. 2 is a cross-section of an embodiment of an electrical initiator.

FIG. 2 is a cross-section of one embodiment of the initiator 10 of the present invention. The initiator 10 includes a header 100 and an output cup 160 of an insulating dielectric material. The header 100 and the output cup 160 define an enclosure filled with an output charge 170, a first primer 40 and a second primer 41. A set of conducting metal pins 20 and 21 are embedded in the header 100. Pin 20 has an inner end 22 and an outer end 23. Pin 21 has an inner end 24 and an outer end 25. The pins 20,21 each have a buttress knurl 50 section which forms a seal with the header 100.

Figure 3:
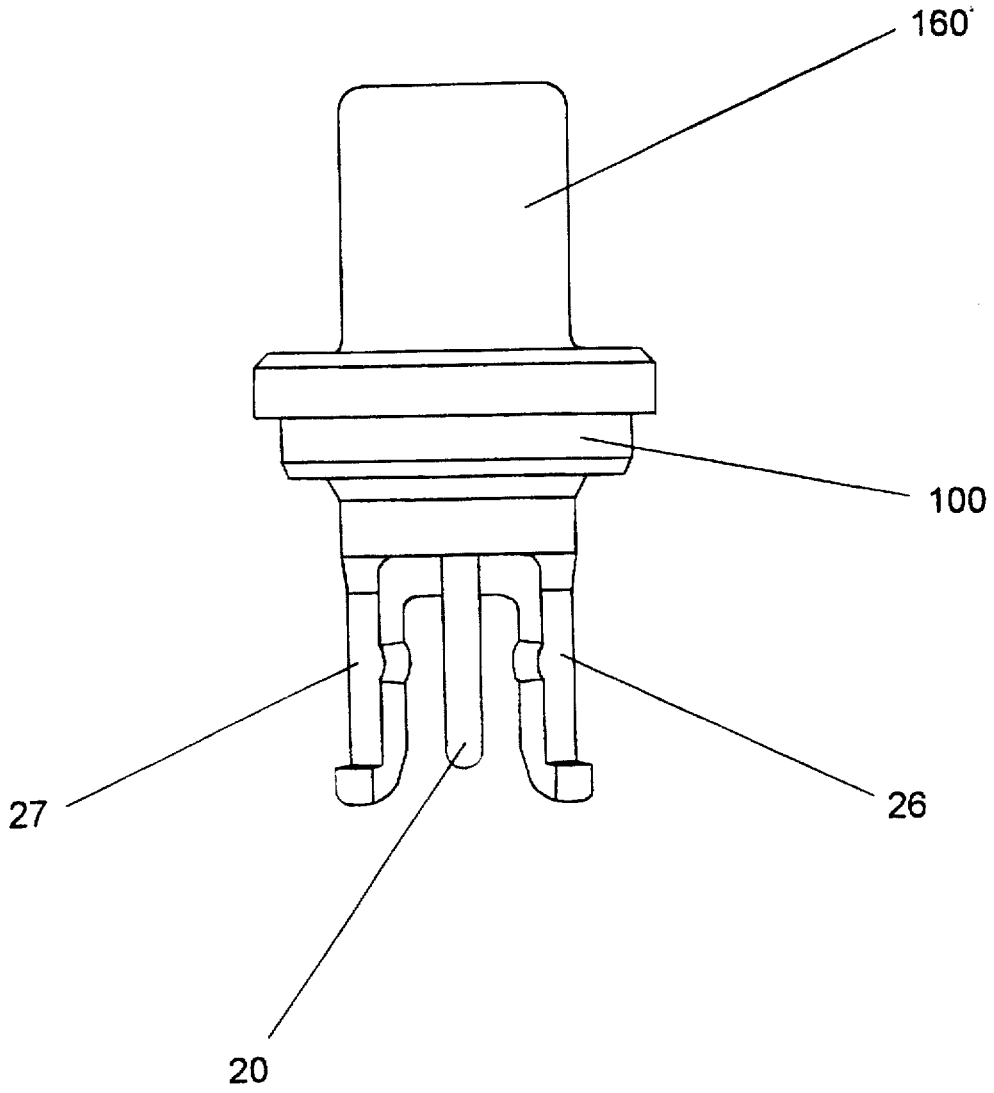
FIG. 3 is an external view of an embodiment of an electrical initiator.

FIG. 3 is an external view of the same embodiment of the initiator 10 shown in FIG. 2 except that the initiator 10 has been rotated 90°. Fingers 26 and 27 aid in maintaining the initiator's 10 connection to an external electrical connector (not shown).

In FIG. 2, each pin 20,21 is preferably surrounded by an epoxy sealant 140 filling recesses 180 and 181. The portion of the pins 20,21 extending outside of the header 100 are used to connect initiator 10 to triggering system 300 (FIG. 1.). Inner end 22 and inner end 24 extend into the enclosure formed by header 100 and output cup 160.

In order to convert the energy in the electric signal arriving at the pins 20,21 into thermal energy necessary to ignite first primer 40 and second primer 41, inner ends 22,24 need to be electrically connected together with some electrically resistive material or device. In a preferred embodiment, that connection is established with a bridgewire 30 composed of metal. In an alternate embodiment, the electrically resistive material or device can be a semiconductor bridge (not shown).

Figure 4:
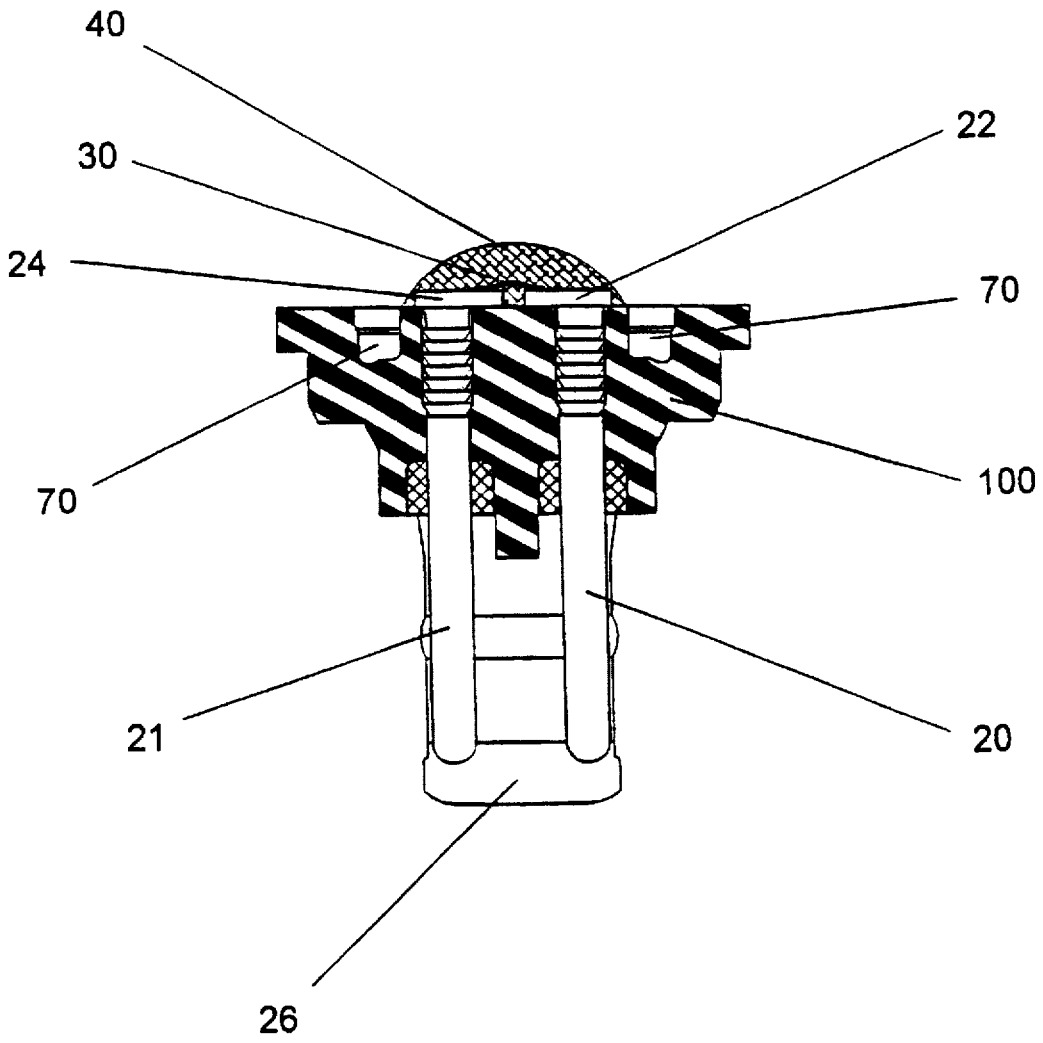
FIG. 4 is a cross-section of an embodiment of a header with pins installed.

FIG. 4 is a cross-section of the header 100 with pins 20,21 and bridgewire 30 of the same embodiment of the initiator 10 shown in FIG. 2. FIG. 4 shows the header before installation of the output cup 160. Cup well 70 provides a place to put the output cup 160 before ultrasonically welding it to header 100. Inner end 22 and 24 and bridgewire 30 make intimate contact with first primer 40.

As shown in FIG. 2, the second primer 41 is identical in composition to first primer 40 and is located at the opposite end of the output cup 160 from header 100. Second primer 41 is used to accelerate the burn rate of the output charge 170, and to simplify the manufacturing process. Proper ignition requires an appropriate total amount of primer. Placing all of the required primer on the bridgewire 30 can make manufacturing difficult. Putting second primer 41 in the output cup 160 means that less first primer 40 can be placed on the bridgewire 30 while still having the proper total amount of primer in the initiator.

In an alternate embodiment, second primer 41 could be of a different composition than first primer 40.

The pins 20,21 are composed of stainless steel to promote a good weld to the bridgewire 30. Gold plating on the inner ends 22,24 will not allow a good bridgewire weld in these circumstances. Therefore, if gold plated pins are used, the gold plating should either be omitted from the inner ends 22,24 at the time the pins are plated or abraded off before welding.

In a preferred embodiment, bridgewire 30 is made from a nickel-chrome-iron alloy called Nichrome. Bridgewire 30 can also be composed of another metal, e.g. stainless steel or platinum. A preferred embodiment uses Nichrome because it has a large temperature coefficient of resistance (TCR) and welds well. The large TCR allows for a thermal transient test after bridgewire 30 is welded and after first primer 40 is added. This test performs a quality check on the weld. This also verifies that the primer 40 has been applied and making good contact with the bridgewire.

Instead of using a piece of metal to connect the inner ends 22,24 together, other resistive devices can be used. For example, a semiconductor bridge suitable for use in the initiator 10 is disclosed in U.S. application Ser. No. 08/023,075, filed Feb. 26, 1993 and commonly assigned to Quantic Industries, the disclosure of which is hereby incorporated by reference. Another embodiment for a semiconductor bridge is disclosed in U.S. Pat. No. 3,366,055 to Hollander, the disclosure of which is hereby incorporated by reference. Another embodiment for a semiconductor bridge is disclosed in U.S. Pat. No. 4,976,200 to Benson, et al. (Sandia), the disclosure of which is hereby incorporated by reference.

Figure 5:
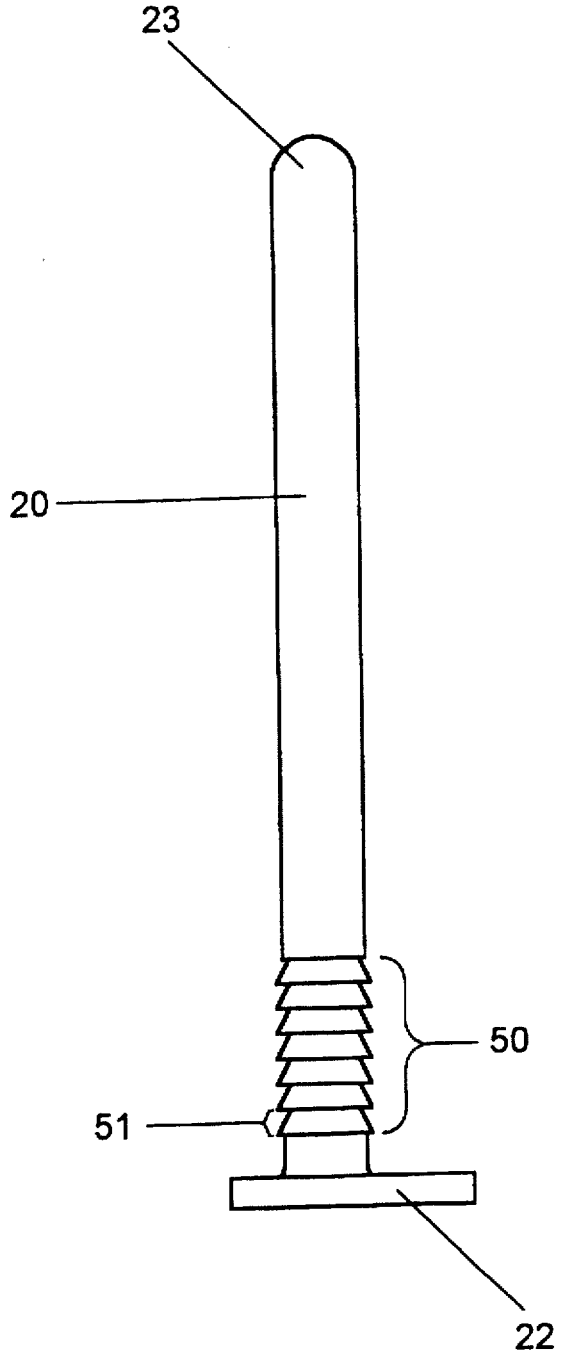
FIG. 5 is an external view of an embodiment of a pin showing a buttress knurl section.

FIG. 5 is an external view of pin 20 showing the inner end 22, outer end 23 and the buttress knurl section 50. The buttress knurl 51 is designed so that the sharp edges extend beyond the pin diameter. They are also designed to engage the header 100 (FIG. 4) in the opposite direction in which the pin is inserted. The design is manufacturable at a low cost by a conventional cold working process used for manufacturing screws or nails. The number of flutes was optimized for retention sealing and manufacturability. The critical features are number, spacing, angle, outside diameter, and their sharpness.

Figure 6:
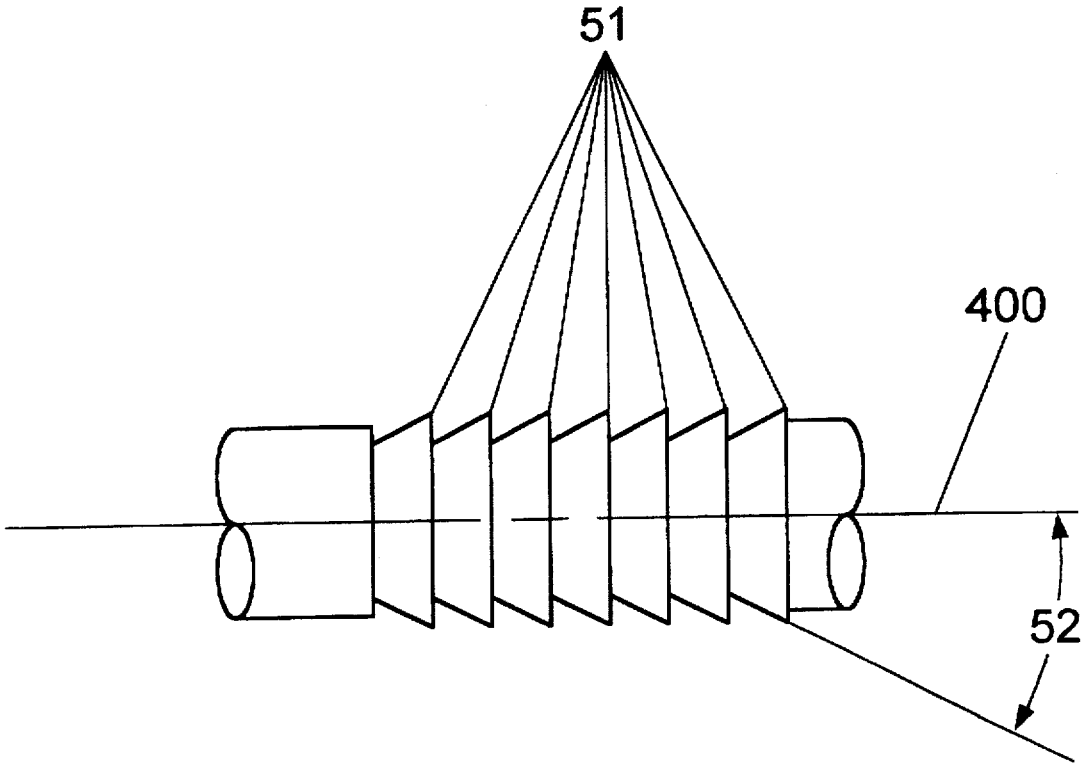
FIG. 6 is an enlarged view of an embodiment of a buttress knurl section.

FIG. 6 shows an enlarged view of a buttress knurl section of the preferred embodiment shown in FIG. 2. Favorable results have been obtained with the following specifications. The flute angle 52 is specified to be 30° off of pin center line 400. The spacing between flutes is specified to be 0.3 millimeters. The flute extends 0.020 millimeters beyond the outer diameter of the pin 20,21. The outer edge of the flute should be made as sharp as possible.

Favorable results have been achieved with the following specifications for pins 20 and 21. The buttress knurl section 50 contains seven flutes 51. The pin 20,21 is specified to be 11.0 millimeters from the side of the inner end 22,24 contacting the header 100 to the outer end 23,25. The pin 20,21 is specified to be 1.0 millimeters in diameter. The inner end 22,24 is specified to be 0.28 millimeters thick and offset from pin center line 400 by 0.66 millimeters.

The operation of the initiator 10 begins with the arrival of an electrical signal at the pins 20 and 21. The electrical signal must produce enough current to heat the bridgewire 30 to the point where the first primer 40 ignites. The preferred embodiment requires 800 milliamps for 2 milliseconds to initiate ignition of the primer discussed below.

For a specified electric current and voltage delivered by the triggering system 300, the ignition characteristics of the initiator 10 can be changed by changing the composition of the primers 40,41, or the resistivity, diameter and length of the bridgewire 30. Changing the composition of the primers 40,41 changes the heat sensitivity, thus making it easier or harder for the primers 40,41 to ignite for a given amount of delivered electric energy. Changing the resistivity, diameter or length of the bridgewire 30 changes its electrical characteristics, thus determining the amount of heat per unit area that the bridgewire 30 produces. In one embodiment, the bridgewire 30 is 0.040 inches long and 0.0009 inches in diameter.

The first primer 40 and the second primer 41 are composed of normal lead styphnate, a binder material, a heat transfer agent, and a solvent. A good choice of a binder material is Florel 2175, a fluroelastomer similar to Kel-F. Kel-F is more widely used but more expensive than Florel 2175. One could also use Kraton which is a thermoplastic rubber, or Viton A or B which are rubber compounds. Aluminum powder or zirconium powder make a good heat transfer additive. Favorable results have been achieved when the primer proportions by dry weight are 85% normal lead styphnate, 5% aluminum, and 10% Florel 2715. The aluminum can range from 3% to 10%, the Florel can range from 6% to 12% with the normal lead styphnate comprising the balance. A solvent is added to this mixture to allow the primer to be applied. A 50%-50% mixture of MIBK or MEK and N-butyl acetate makes a good solvent. To make the primer slurry needed for making the initiator, it is preferred to add an amount of the specified solvent composing 30% of the weight of the dry primer. For best results, the slurry should be of a uniform consistency. Therefore, the slurry should be kept agitating until it is used.

Zirconium/potassium perchlorate could be used instead of normal lead styphnate, but it is not as temperature sensitive. However, zirconium/potassium perchlorate does not need to have aluminum added because the zirconium provides good heat transfer characteristics. Favorable results could be achieved using a zirconium/potassium perchlorate mixture with 45% to 55% zirconium by weight with the balance being potassium perchlorate. The zirconium/potassium perchlorate mixture can be combined with a binder that composes 3% to 10% by weight of the zirconium/potassium perchlorate and binder mixture.

Additionally, the primers 40,41 must be resilient enough to withstand damage from vibrations from the ultrasonic welding process which connects the output cup 160 to the header 100. The choice of materials in this embodiment provides primers 40,41 that do not transfer damaging vibrations to the bridgewire 30.

The output charge 170 needs to be composed of materials that will produce hot gases and particles that will cause the solid gas generant 305 to change into a gas. The output charge must also not degrade over time or with variations in temperature.

In one embodiment, favorable results are obtained when using 50 milligrams of $BKNO_3$ for the output charge 170, 20 milligrams of the favorable primer mix for the first primer 40, and 20 milligrams of the favorable primer mix for the second primer 41.

The header 100 and output cup 160 are injection molded from a material, such as Valox DR48, which is resistant to the automotive environment and which can be ultrasonically welded. The pins 20,21 are formed with a buttress knurl 50. The pins 20,21 can be either machined or cold formed. Cold forming reduces cost. The knurl is an important factor in rigidly retaining the pins in the header and in providing a durable environmental seal. Each pin 20,21 is then inserted into the header 100 with a force of approximately 300 pounds so that each pin 20,21 is driven into the header 100 and the inner end 22,24 is at an approximate height of 0.020 inches above the header 100. During this insertion the pins 20,21 are pushed into the header 100 so that the buttress knurl section 50 fully engages the header 100. In one embodiment, each pin 20,21 is inserted separately. When the insertion force is removed from a pin 20,21, the natural spring back of the plastic material comprising the header 100 forces the pin 20 or 21 back up. The buttress knurl section 50 as formed has sharp edges which bite or cut into the plastic of the header 100 when the pin 20 or 21 tries to spring back. This allows the buttress knurl 50 to bite into the header material like the back of a hook. This biting into the plastic forms a seal at each edge of the buttress knurl section 50. The multiple sharp edges of the buttress knurl section 50 provide an environmental seal between the pin 20,21 and the plastic comprising the header 100.

Then, to further assure the integrity of the seal, epoxy 140 is deposited and cured in the recesses 180,181 at the base of the header. In a preferred embodiment, a one part epoxy pre-form, such as a DC-003 Uni-Form can be used. DC-003 Uni-Form is available from Multi-Seals, Inc.

The next step is to resistance weld the bridgewire 30 to the inner ends 22,24. The bridgewire 30 is formed with a loop at the time it is welded to the pins 20,21 by one of two ways. Bridgewire 30 can be drawn over a half-round pin and welded at the end. Alternatively, the machine performing the weld can form the wire itself.

The first primer 40 is in the form of a slurry or suspension and is deposited on the bridgewire 30 by either a painting process or by dispensing it directly onto the bridgewire 30 with a series of automatic dispensing stations. One such station is an air over liquid dispenser made by EFD Inc. To achieve high process uniformity the primer 30 it is recommended that the primer 30 be continuously agitated during the manufacturing to assure homogeneity. The initiator 10 works best if the first primer 40 covers the bridgewire 30 completely. After application, the solvent is evaporated from the slurry by placing the parts in an oven for about two hours at about 140° F.

The second primer 41 is composed of the same material as the first primer 40, and is in a slurry or suspension form. It is placed in the bottom of the output cup 160, and dried in the same manner as the first primer 40.

In an alternative embodiment, an initiator 10 can use the same material for both the primer and output charge. The choice of output charge and primer depends on the use intended and the cost of the materials. The primer must be sensitive to thermal energy. The output charge must provide the proper ignition characteristics for the gas generant which the initiator ignites.

In a preferred embodiment, an output charge 170 of $BKNO_3$ is a dry powdery or granular material such as a 20/48 mesh. A fixed amount of the output charge is poured into the output cup 160.

Next, the header 100 is placed onto the output cup 160 and ultrasonically welded together. In an alternate embodiment, header 100 can be thermally welded onto output cup 160.

As an alternate embodiment of a gas generating system 303 (FIG. 1), the initiator 10 can be modified to eliminate the need for a solid gas generant enclosure 304 (FIG. 1). This can be achieved by using a solid gas generant, such as a single base smokeless powder, instead of the output charge 170 (FIG. 2) in the output cup 160 (FIG. 2), and making the following modifications.

The output cup 160 (FIG. 2) must be expanded to accommodate the larger mass of the solid gas generant required to produce the gas. Second primer 41 (FIG. 2) is not required.

Favorable results have been obtained using 500 milligrams to 1500 milligrams of smokeless powder, and modifying the dimensions of the output cup 160 accordingly. Also, using 10 milligrams to 40 milligrams of the previously described primer mix yields good performance.

The solvent mixture component MIBK is methyl isobutyl ketone and is commonly available in the industry. The solvent mixture component MEK is methyl ethyl ketone and is commonly available in the industry. The solvent mixture component N-butyl acetate is commonly available in the industry. Black powder is made by Goex, among others, and is commonly available in the industry. Normal lead styphnate is made by Olin, among others, and is commonly available in the industry. Nichrome is a metal alloy that is commonly known and available in the industry. $BKNO_3$ is available from PSI and Tracor, and is commonly known in the industry. Smokeless powder is commonly known, and is available from IMR.

The following chemicals are commonly known to those skilled in the art of initiators. Valox DR48 is available from General Electric, and is polybutylene terephthalate (PBT). Florel 2175 is available from 3M. Kel-F is available from DuPont. Kraton is made by Shell Chemical. Viton A and Viton B are made by Dupont.

It will be appreciated by those of ordinary skill in the art that many variations in the foregoing preferred embodiments are possible while remaining within the scope of the present invention. This application includes, but is not limited to, automobile air bags, seat belt pretensioners, and other similar applications. The present invention should thus not be considered limited to the preferred embodiments or the specific choices of materials, configurations, dimensions, applications, or ranges of functional parameters employed therein.

What is claimed is:

1. A gas tight seal, comprising:

an elastic header for an automotive electrical initiator;

a pin traversing and engaging the elastic header such that the elastic header establishes and maintains a sealing force between the header and the pin to form a reliable environmental seal capable of withstanding an automotive environment.

2. The gas tight seal of claim 1, wherein the elastic header comprises a plastic material.

3. The gas tight seal of claim 1, wherein the pin has buttress knurls.

4. The gas tight seal of claim 3, wherein the buttress knurls comprise a barb and the pin is inserted into and expands a hole in the header such that a compression seal is formed between the pin and the header and such that the pin springs back from being inserted into the hole, causing the barb to bite into the header to enhance the gas tight seal.

5. The gas tight seal of claim 2, wherein the pin has buttress knurls.

6. The gas tight seal of claim 5, wherein the buttress knurls comprise a barb and the pin is inserted into and expands a hole in the header such that a compression seal is formed between the pin and the header and such that the pin springs back from being inserted into the hole, causing the barb to bite into the header to enhance the gas tight seal.

* * * * *